United States Patent [19]

Leroy

[11] 4,081,268

[45] Mar. 28, 1978

[54] METHOD OF PROTECTING TUYERES FOR UPWARDLY BLOWING PURE OXYGEN THROUGH THE BOTTOM OF STEEL CONVERTERS

[75] Inventor: Pierre Leroy, Saint-Germain-en-Laye, France

[73] Assignee: Creusot-Loire, Paris, France

[21] Appl. No.: 786,949

[22] Filed: Apr. 12, 1977

[30] Foreign Application Priority Data

Apr. 28, 1976 France ..... 76 12544

[51] Int. Cl.[2] ..... C21C 5/34

[52] U.S. Cl. ..... 75/52; 75/51; 75/59; 75/60

[58] Field of Search ..... 75/51, 52, 59, 60

[56] References Cited

U.S. PATENT DOCUMENTS 3,706,549 12/1972 Knuppel ..... 75/59

3,751,242 8/1972 Knuppel ..... 75/52

3,992,194 11/1976 Leroy et al. ..... 75/60

*Primary Examiner*—P. D. Rosenberg

*Attorney, Agent, or Firm*—Haseltine, Lake & Waters

[57] ABSTRACT

In use of a steel converter into which oxygen is blown through tuyeres, each tuyere being protected by flow of a protective liquid containing hydrocarbons along peripheral passage means in the tuyere, the tuyeres are protected against wear by dividing the refining process into at least two stages, in the first stage which extends from the beginning of the refining process to a point at which the carbon level in the molten metal is 0.300 to 0.700% the protective liquid flows at a first rate and in the second stage which extends from the end of the first stage to a point at which at least 90% of the total amount of oxygen has been blown in, the protective liquid flows at a second rate in the range 0.08 to 0.15 liters per minute per centimeter of the mean circumference of the passage means in each tuyere, the first rate being in the range 0.4 to 0.6 times the second rate.

8 Claims, No Drawings

METHOD OF PROTECTING TUYERES FOR UPWARDLY BLOWING PURE OXYGEN THROUGH THE BOTTOM OF STEEL CONVERTERS

The present invention is concerned with a method of protecting tuyeres for blowing pure oxygen upwardly through the bottom of steel converters.

The invention is applicable to tuyeres which comprise two or three concentric tubes and which are protected against high-temperature wear by a liquid which contains a hydrocarbon, such for example as fuel oil.

A known steel converter for refining molten iron into steel has a bottom fitted with a number of tuyeres consisting of two concentric tubes, pure oxygen being supplied to the inner tube and a liquid which contains hydrocarbons being supplied to the space between the two tubes.

Powdered lime or limestone, or other finely divided materials which are of use in the refining process can be carried in suspension in the oxygen. The optimum flow rate for the oxygen at any time depends on the permeability of the oxygen circuit, including that of the tuyeres, on the blowability, i.e. on the amount of splashing produced by the converter, and on the length of time which the blowing is likely to last, taking into account the time required to melt any scrap iron, for example. This is so whether the oxygen is charged with powdered material or not.

There are many ways of supplying the tuyeres with the protective liquid which contains hydrocarbons. The traditional method in the case of fuel oil consists in maintaining a constant flow of fuel oil throughout the refining process. This method has the obvious advantage of simplicity, which accounts for its success. But it also has the disadvantages of being too elementary. The flow rate which is generally adopted in using this method, which is referred to as the normal flow (NF) rate, is sufficient to effectively prevent the maximal wear of the tuyeres, which only occurs when the carbon content of the molten metal is low, in other words only during the final stage of the process. During most of the blow, before low carbon levels are achieved in the molten metal, this rate of flow is excessive. A much lower flow rate would be sufficient, but it would then be necessary to adjust the flow rate during the blow. Thus the main disadvantage of this method of blowing, using a constant flow of fuel oil, is the excessive consumption of fuel oil, which can be in the region of 5 liters per ton of steel in small converters (less than 20 ton capacity), 3 liters per ton of steel in 30 to 40 ton converters, and 2.4 liters per ton of steel in 60 to 70 ton converters.

It might be thought that the flow of fuel oil should be made entirely dependent on the flow of oxygen, and even that the flow of fuel oil should be automatically controlled, in accordance with the flow of oxygen.

However the flow of oxygen is dependent on the blowing pressure and the cross-section of the central tube of the tuyere in question, and therefore on the square of the diameter of the central tube. Thus the main disadvantage of a method such as is mentioned in the preceding paragraph is that the oxygen flow controls the flow of protective liquid in an annular passage, which depends on the dimensions of the annulus which forms the cross-section of the passage.

As the size of a tuyere is increased, the diameter of this annulus increases with the diameter of the central tube, but not with the square of that diameter.

Also, as the pressure of the oxygen is raised for a given tuyere, the oxygen flow rate increases, which increases the cooling effect at the tip of the tuyere caused by expansion of the oxygen. This makes the tuyere more resistant to wear, so that there is no need to increase the flow of protective liquid, other things being equal.

The applicants have now carried out systematic experiments which have led to the surprising result that the high-temperature wear of the tips of the tuyeres by the molten metal is in no way dependent on the oxygen flow. It is in inverse relation to the carbon level in the molten metal and to the concentration of powdered material in the flow of oxygen, due account being taken of the intrinsic cooling effect of this material. The first of these parameters, the carbon level in the molten metal, is of greater importance than the second.

According to one aspect of the present invention there is provided a method of protecting tuyeres for blowing pure oxygen through the bottom of a steel converter, the method comprising supplying a protective liquid which contains hydrocarbons to peripheral passage means in each tuyere and varying the rate of flow of said protective liquid, so that said protective liquid flows at a reduced rate during a first stage, which first stage extends from the beginning of the refining process to a point at which the carbon level in the molten metal is 0.300 to 0.700%, and at a normal rate during a second stage, which second stage extends from the end of said first stage to a point at which 90 to 95% of the total amount of oxygen required for refining the molten metal has been blown in, and at an excess rate during a third and final stage, which third stage extends from the end of said second stage to the point at which all the oxygen has been blown in, said normal flow rate being in the range 0.08 to 0.15 liters per minute per centimeter of the mean circumference of said passage means in each tuyere through which said protective liquid flows, said reduced flow rate being from 0.4 to 0.6 times said normal flow rate and said excess flow rate being from 1.5 to 2 times said normal flow rate.

The normal flow rate is that required for a satisfactory tuyere service life if a constant flow of protective liquid is used throughout the refining process.

Whether the passage for the protective liquid is a narrow but continuous annulus or a series of discontinuous areas arranged in a ring, if the transverse cross-section of the passage is relatively high, i.e. between 5 and 20 $mm^2$ per centimeter of its mean circumference, which is equivalent to a gap of 0.5 to 2 mm in the case of two concentric tubes, the normal flow rate for the protective liquid is between 0.12 and 0.15 liter per minute per centimeter of the mean circumference.

If the cross-section of the passage is particularly small, i.e. between 0.6 and 5 $mm^2$ per centimeter of the mean circumference, which is equivalent to a gap of 0.06 to 0.5 mm in the case of two concentric tubes, the normal flow rate for the protective liquid is between 0.08 and 0.12 liter per minute per centimeter of the mean circumference.

For a tuyere comprising two concentric tubes of 21mm/27mm for the oxygen and 28mm/34mm for the protective liquid, the mean diameter of the annular passage for the liquid is 27.5 mm, and its mean circumference is 86.5 mm, or 8.65 cm. the "normal" flow rate for the protective liquid in this tuyere, according to the above-mentioned definition, is $0.12 \times 8.65 = 1.04$ 1/min.

For another tuyere comprising two concentric tubes of 28mm/34mm for the oxygen and 36mm/42mm for the protective liquid, the mean diameter of the annular liquid passage is 35 mm and the mean circumference is 110 mm, or 11 cm. The "normal" flow rate for the protective liquid in this tuyere, according to the above-mentioned definition, is $0.13 \times 11 = 1.43$ 1/min.

For another tuyere, with a much narrower passage for the protective liquid, comprising two concentric tubes of 28mm/34mm for the oxygen and 34mm/42mm for the protective liquid, the outer wall of the inner tube bearing long, shallow grooves separated by narrow lands, such that the cross-section of the passage for the protective liquid is 1 $mm^2$ for every centimeter of its mean circumference, the mean circumference is 107 mm, i.e. 10.7 cm, so that the "normal" flow rate for the protective liquid, according to the abovementioned definition, is $0.085 \times 10.7 = 0.91$ 1/min.

The method in accordance with the invention may for example be used in the refining of iron containing 1.5 to 2.1% phosphorus (Thomas-Gilchrist process), and in the refining of low phosphorus iron (less than 0.300%). In both cases the end product of the blowing in of pure oxygen is mild steel.

In one embodiment of the method in accordance with the invention, used in the refining of phosphoric iron containing 1.5 to 2.1% phosphorus, the molten metal is desilicated and decarburized during said first stage, said first stage extending to the point at which the carbon content of the molten metal is 0.300 to 0.700%, during said second stage decarburization of the molten metal is completed and the greater part of its dephosphorization is carried out, said second stage extending to the point at which 90 to 95% of the total amount of oxygen required for refining the molten metal has been blown in, and during said third stage dephosphorization of the molten metal is completed and the rate of oxidation of the iron is rapidly increased, said third stage extending from the end of said second stage to the point at which said refining process is completed.

In another embodiment of the method in accordance with the invention, used in the refining of low phosphorus iron into mild steel, during said first stage the molten metal is desilicated and decarburized, said first stage extending to the point at which the carbon content of the molten metal is 0.300 to 0.700%, during said second stage the decarburization of the molten metal is completed, said second stage extending to the point at which 90 to 95% of the total amount of oxygen required for refining the molten metal has been blown in, and during said third stage the decarburization of the molten metal is completed and the rate of oxidation of the iron is rapidly increased, said third stage extending from the end of said second stage to the point at which the refining process is completed.

In accordance with another aspect of the present invention, when manufacturing semi-mild and medium carbon steels from low phosphorus iron by terminating the refining process at a carbon level above 0.100%, i.e. before reaching the very low levels of carbon in low carbon steels, the third and final stage is omitted, or in other words the protective liquid is not caused to flow at an excess flow rate, the normal flow rate being maintained beyond the point at which 90 to 95% of the oxygen has been blown in, to the point at which the required carbon content of the molten metal is achieved, i.e. until the end of the refining process.

All that has been said so far is applicable to the blowing of pure oxygen containing no suspended powdered material, and also to the blowing of pure oxygen containing up to 3 kg per cubic meter of powdered lime or up to 1.5 kg per cubic meter of powdered limestone.

For concentrations of these powdered materials above the preset values, resulting in an increased cooling effect at the tip of each tuyere, according to another aspect of the present invention, the flow rate of the protective liquid in each stage is reduced in linear relation to the ratio between the relevant preset value given above and the amount of the powdered material, so that if the amount of powdered material is twice the preset value, the flow rate of the protective liquid is halved.

It will be understood that the above described method has a number of important advantages.

Firstly, by limiting the number of stages to three, it is possible to keep the method relatively simple, so that it is easy to put into practice.

Secondly, the method can be closely adapted to the changing speed at which the tips of the tuyeres are attacked by the iron oxides, in accordance with the decreasing carbon content of the molten metal, and this means that the amount of protective liquid consumed can be significantly reduced in comparison with the conventional method in which the liquid flows at a constant rate throughout the blowing operation.

The excess flow rate during the third stage has a deoxidizing effect, in addition to its protective effect, during the last few seconds of the blow, and may even have a slight recarburizing effect. This is due to the carbon produced by the cracking of the excess liquid. The excess flow does not significantly increase the amount of protective liquid that is used up, as it occurs only during the third and final stage, which is a very short one, accounting for only the final 10% to 5% of the total amount of oxygen blown in.

The reduction in the flow rate of the protective liquid in response to the amount of powdered lime or limestone in the oxygen passing the preset value contributes to a further reduction in the amount of liquid consumed, while avoiding the formation on the tips of the tuyeres of "mushrooms", or swollen beads of solidified metal, which have an adverse effect on the proper flow of oxygen and on the resistance of the tuyeres.

Another advantage is that the method is very suitable for automation, i.e. automatic control on the basis of the total amount of oxygen blown since the beginning of the refining process.

The invention will be more fully understood from the following embodiments thereof, given by way of example only.

In both embodiments the converter used has a capacity of 60 tons and has seven tuyeres, each of which consists of two concentric tubes, a 28mm/34mm tube for the oxygen and a 36mm/42mm tube for the protective liquid, which consists of domestic fuel oil.

With these tuyeres, the normal flow rate NF of the fuel oil is of the order of 1.43 liters per minute in each tuyere, as previously explained. In this example the flow rate NF is set at 1.5 1/min/tuyere.

In the first embodiment of the method, a phosphorus iron is to be refined into mild (low carbon) steel. The iron contains 0.400% silicon, 0.360% manganese, 3.65% carbon, 1.82% phosphorus, and 0.036% sulphur.

The total volume or oxygen to be blown in, to make 60 tons of steel, is 3360 $Nm^3$. The three stages are as follows:

First stage

This extends from the beginning of the refining process to the point at which 2 200 $Nm^3$ (65.5%) of the total amount of oxygen has been blown. The carbon level of the molten metal is not determined, but is in the region of 0.500% at this time. Throughout this first stage the fuel oil flows at a reduced rate RF = 0.5 × NF = 0.75 1/min/tuyere. The total flow rate for all seven tuyeres is therefore 5.25 1/min. In this embodiment, the first stage lasts 8½ minutes.

Second stage

This extends from the end of the first stage to the point at which 3 200 $Nm^3$ of oxygen have been blown in (95%), and the fuel oil flow rate is the normal rate NF of 1.5 1/min/tuyere, i.e. a total of 10.5 1/min for all seven tuyeres. This second stage includes the final phases of the decarburization of the molten metal, and the greater part of its dephosphorization. The phosphorus level is not measured at the end of the second stage, but is in the region of 0.170%. In this embodiment, the second stage lasts 3 minutes.

Third stage

This extends up to the point at which all the 3 360 $Nm^3$ of oxygen have been blown in, i.e. to the end of the blowing operation, and includes the final stages of the dephosphorization and the beginning of the peroxidation of the iron. The fuel oil flows at the excess rate EF = 1.6 × NF = 2.4 1/min/tuyere, i.e. a total of 16.8 1/min for all seven tuyeres. The phosphorus level of the molten metal is measured at the end of the third stage, and is found to be 0.024%. The carbon level is 0.033%. In this embodiment, the third stage lasts 30 seconds.

Thus the total amount of fuel oil consumed during the blow is (5.25 × 8.5) + (10.5 × 3) + (16.8 × 0.5) = 84.5 liters. The total amount consumed per ton of steel is therefore 84.5/60 liters, i.e. 1.4 liters.

The known method using a constant flow of fuel oil uses up about 2.4 liters per ton of steel in a 60 ton converter. The saving provided by use of the above described method is therefore in the region of 1 liter per ton of steel, or some 42%.

Throughout the process the amount of powdered lime in the oxygen was less than 3 kg/$Nm^3$ of oxygen, requiring no correction of the fuel oil flow rate. No powdered limestone was used.

In the second embodiment of the method a low phosphorus iron ("haematite" iron) is to be refined, the composition of the iron being: 0.800% silicon, 0.700% manganese, 4.4% carbon, 0.160% phosphorus, and 0.038% sulphur.

The total volume of oxygen to be blown in, to make 60 tons of steel, is 3 060 $Nm^3$. The three stages are as follows:

First stage

This extends up to the point at which 2 450 $Nm^3$ of oxygen have been blown in (80%). The carbon level of the molten metal is not measured at this point, but is of the order of 0.600%. The first stage lasts nine minutes, and is sub-divided into two parts: during the first part, which lasts three minutes, the amount of powdered lime in the pure oxygen is 4 kg/$Nm^3$ of oxygen. This is greater than the limit value of 3 kg/$Nm^3$, and is required to prevent splashing caused by the high silicon content of the iron. During the final six minutes of the first stage the amount of lime is less than 3 kg/$Nm^3$ of oxygen.

During the first 3 minutes, the fuel oil flow rate per tuyere is a reduced rate $RF_1$ = 0.5 × NF × 5/6 = 0.625 1/min/tuyere, so that the total flow rate for all seven tuyeres is 4.375 1/min.

During the final six minutes, the flow rate per tuyere is a reduced rate $RF_2$ = 0.5 × NF = 0.75 1/min/tuyere, so that the total flow rate for all seven tuyeres is 5.25 1/min.

Second stage

This extends from the end of the first stage up to the point at which 2 900 $Nm^3$ of oxygen have been blown in (94.8%). The fuel oil flows at the normal rate NF of 1.5 1/min/tuyere, i.e. 10.5 1/min for all seven tuyeres. The carbon level of the molten metal is not measured at the end of the second stage, but it is known to be in the region of 0.130%. In this embodiment, the second stage lasts 1½ minutes.

Third stage

This extends from the end of the second stage to the point at which all 3 060 $Nm^3$ of oxygen have been blown in, i.e. up to the end of the blowing operation, and includes the final phases of the decarburization of the iron and the initial stages of its peroxidation. The fuel oil flows at the excess rate EF = 1.6 NF = 2.4 1/min/tuyere, i.e. 16.8 1/min for all seven tuyeres. The carbon level of the molten metal is measured at the end of this third and final stage, and is found to be 0.034%. In this embodiment, the third stage lasts 30 seconds.

Thus the total amount of fuel oil consumed during the blow is (4.375 × 3) + (5.25 × 6) + (10.5 × 1.5) + (2.4 × 0.5) = 61.575 liters. The total amount consumed per ton of steel is therefore 61.575/60 1, i.e. 1.02 liters.

Apart from the first three minutes of the first stage, the amount of powdered lime in the oxygen was less than 3 kg/$Nm^3$ of oxygen, requiring no other correction of the fuel oil flow rate than that applied during the first three minutes of the first stage.

It will be understood that details of the above described methods may be modified and improved, and that equivalent means may be substituted, without departing from the scope of the invention.

To avoid complicating the description of the invention given up to this point, no mention has been made of the minor variations in the fuel oil flow rate which are produced from one tuyere to the next, in order to slow down an undue rate of wear of one tuyere, or to prevent the formation of "mushrooms" on another. Such corrections are common practice, although they are rarely met with, and can easily be carried out by those skilled in the art, especially when the flow rate of the protective liquid is adjusted one tuyere at a time.

Thus, if these minor corrections to the flow rate of individual tuyeres are ignored, the normal, reduced and excess flow rates mentioned above apply to the individual tuyeres or, with the appropriate multiplication factor (i.e. the number of tuyeres), to the set of tuyeres as a whole.

What is claimed is:

1. A method of protecting tuyeres for blowing pure oxygen through the bottom of a steel converter, the method comprising supplying a protective liquid which contains hydrocarbons to peripheral passage means in each tuyere and varying the rate of flow of said protective liquid, so that said protective liquid flows at a reduced rate during a first stage, which first stage extends from the beginning of the refining process to a point at which the carbon level in the molten metal is 0.300 to 0.700%, and at a normal rate during a second stage, which second stage extends from the end of said first stage to a point at which 90 to 95% of the total amount of oxygen required for refining the molten metal has been blown in, and at an excess rate during a third and final stage, which third stage extends from the end of said second stage to the point at which all the oxygen has been blown in, said normal flow rate being in the range 0.08 to 0.15 liters per minute per centimeter the mean circumference of said passage means in each tuyere through which said protective liquid flows, said reduced flow rate being from 0.4 to 0.6 times said normal flow rate and said excess flow rate being from 1.5 to 2 times said normal flow rate.

2. A method according to claim 1, wherein the transverse cross-section of said passage means in each tuyere for said protective liquid is between 5 and 20 millimeters square for each centimeter of the mean circumference of said passage means, and said normal flow rate is between 0.12 and 0.15 liters per minute per centimeter of said mean circumference.

3. A method according to claim 1, wherein the transverse cross-section of said passage means in each tuyere for said protective liquid is between 0.6 and 5 square millimeters for each centimeter of the mean circumference of said passage means, and said normal flow rate is between 0.08 and 0.12 liters per minute per centimeter of said means circumference.

4. A method according to claim 1, used in the refining of phosphoric iron containing 1.5 to 2.1% phosphorus, wherein the molten metal is desilicated and decarburized during said first stage, said first stage extending to the point at which the carbon content of the molten metal is 0.300 to 0.700%, during said second stage decarburization of the molten metal is completed and the greater part of its dephosphorization is carried out, said second stage extending to the point at which 90 to 95% of the total amount of oxygen required for refining the molten metal has been blown in, and during said third stage dephosphorization of the molten metal is completed and the rate of oxidation of the iron is rapidly increased, said third stage extending from the end of said second stage to the point at which said refining process is completed.

5. A method according to claim 1, used in the refining of low phosphorus iron into mild steel, wherein, during said first stage the molten metal is desilicated and decarburized, said first stage extending to the point at which the carbon content of the molten metal is 0.300 to 0.700%, during the second stage the decarburization of the molten metal is completed, said second stage extending to the point at which 90 to 95% of the total amount of oxygen required for refining the molten metal has been blown in, and during said third stage the decarburization of the molten metal is completed and the rate of oxidation of the iron is rapidly increased, said third stage extending from the end of said second stage to the point at which the refining process is completed.

6. A method of protecting tuyeres for blowing pure oxygen through the bottom of a steel converter used to refine low phosphorus iron containing less than 0.300% phosphorus into low and medium carbon steels by terminating the refining process at a carbon level slightly greater than 0.100%, the method comprising supplying a protective liquid which contains hydrocarbons to peripheral passage means in each tuyere and varying the rate of flow of said protective liquid, so that said protective liquid flows at a reduced rate during a first stage, which first stage extends from the beginning of the refining process to a point at which the carbon level in the molten metal is 0.300 to 0.700%, and at a normal rate during a second stage, which second stage extends from the end of said first stage to the point at which the refining process is complete, said normal flow rate being in the range 0.08 to 0.15 liters per minute per centimeter of the mean circumference of said passage means in each tuyere through which said protective liquid flows, and said reduced flow rate being from 0.4 to 0.6 times said normal flow rate.

7. A method of protecting tuyeres for blowing pure oxygen containing more than a preset amount of powdered lime or limestone, said preset amounts being 3 kg of powdered lime per $Nm^3$ of oxygen and 1.5 kg of powdered limestone per $Nm^3$ of oxygen through the bottom of a steel converter, the method comprising supplying a protective liquid which contains hydrocarbons to peripheral passage means in each tuyere and varying the rate of flow of said protective liquid, so that said protective liquid flows at a first rate during a first stage, which first stage extends from the beginning of the refining process to a point at which the carbon level in the molten metal is 0.300 to 0.700%, and at a second rate during a second stage, which second stage extends from the end of said first stage to a point at which 90 to 95% of the total amount of oxygen required for refining the molten metal has been blown in, and at a third rate during a third and final stage, which third stage extends from the end of said second stage to the point at which all the oxygen has been blown in, said second flow rate being in the range $0.08x$ to $0.15x$ liters per minute per centimeter of the mean circumference of said passage means in each tuyere through which said protective liquid flows, said first flow rate being from 0.4 to 0.6 times said second flow rate and said third flow rate being from 1.5 to 2 times said second flow rate, $x$ being the ratio between the preset amount of powdered lime or limestone and the actual amount of powdered lime or limestone.

8. A method of protecting tuyeres for blowing pure oxygen containing more than a preset amount of powdered lime or limestone, said preset amounts being 3 Kg of powdered lime per Nm3 of oxygen and 1.5 Kg of powdered limestone per Nm3 of oxygen through the bottom of a steel converter, the method comprising supplying a protective liquid which contains hydrocarbons to peripheral passage means in each tuyere and varying the rate of flow of said protective liquid, so that said protective liquid flows at a first rate during a first stage, which first stage extends from the beginning of the refining process to a point at which the carbon level in the molten metal is 0.300 to 0.700%, and at a second rate during a second stage, which second stage extends from the end of said first stage to the point at which the refining process is complete, said second flow rate being in the range $0.08\ x$ to $0.15\ x$ liters per minute per centimeter of the mean circumference of said passage means in each tuyere through which said protective liquid flows, said first flow rate being from 0.4 to 0.6 times said second flow rate, $x$ being the ratio between the preset amount of powdered lime or limestone and the actual amount of powdered lime or limestone.

* * * * *